US009634413B2

(12) United States Patent
Hashiguchi et al.

(10) Patent No.: US 9,634,413 B2
(45) Date of Patent: Apr. 25, 2017

(54) CONNECTOR

(71) Applicant: Japan Aviation Electronics Industry, Limited, Tokyo (JP)

(72) Inventors: Osamu Hashiguchi, Tokyo (JP); Ryuzo Shimeno, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/822,322

(22) Filed: Aug. 10, 2015

(65) Prior Publication Data

US 2016/0126654 A1 May 5, 2016

(30) Foreign Application Priority Data

Nov. 4, 2014 (JP) ..... 2014-224150

(51) Int. Cl.

| | |
|---|---|
| ***H01R 11/22*** | (2006.01) |
| ***H01R 13/11*** | (2006.01) |
| ***H01R 4/16*** | (2006.01) |
| ***H01R 4/02*** | (2006.01) |
| ***H01R 12/71*** | (2011.01) |
| *H01R 13/115* | (2006.01) |

(52) U.S. Cl.

CPC ..... *H01R 13/11* (2013.01); *H01R 4/02* (2013.01); *H01R 4/16* (2013.01); *H01R 12/718* (2013.01); *H01R 13/113* (2013.01); *H01R 13/115* (2013.01)

(58) Field of Classification Search

CPC .... H01R 13/11; H01R 12/718; H01R 13/113; H01R 4/16; H01R 4/02; H01R 13/115

USPC ..... 439/83, 851, 857

See application file for complete search history.

(56) References Cited

U.S. PATENT DOCUMENTS

| | | | |
|---|---|---|---|
| 4,699,444 | A | 10/1987 | Isohata |
| 5,941,740 | A | 8/1999 | Neuer et al. |
| 6,293,832 | B1 | 9/2001 | Yamamoto |

FOREIGN PATENT DOCUMENTS

| | | | |
|---|---|---|---|
| DE | 102006062022 | A1 | 7/2008 |
| EP | 0057757 | A2 | 8/1982 |
| EP | 0913885 | A1 | 5/1999 |
| JP | S4926084 | U | 3/1974 |
| JP | 10-503319 | A | 3/1998 |

*Primary Examiner* — Khiem Nguyen

(74) *Attorney, Agent, or Firm* — Muncy, Geissler, Olds & Lowe, P.C.x

(57) ABSTRACT

A connector has a socket contact to be electrically connected to a counter-connector contact, the socket contact including: one or more pairs of conduction contact points disposed respectively on both sides of a fitting plane in an elastically displaceable manner; and one or more pairs of displacement regulator contact points disposed respectively on both sides of the fitting plane and coming into contact with the counter-connector contact when the counter-connector contact shifts, the one or more pairs of conduction contact points and the one or more pairs of displacement regulator contact points are disposed side by side in a direction along the fitting plane at a substantially same depth in a fitting direction, each of the pairs of displacement regulator contact points having a gap therebetween larger than that in each of the pairs of conduction contact points.

9 Claims, 5 Drawing Sheets

CONNECTOR

BACKGROUND OF THE INVENTION

The present invention relates to a connector, in particular, to a connector having a socket contact to be electrically connected to a counter-connector contact having a plate shape.

The socket contact of a connector of this type has a spring contact point capable of elastic displacement. At the time of engagement of connectors, a counter-connector contact is inserted into the socket contact relatively along a fitting plane and comes into contact with the spring contact point of the socket contact, while elastically shifting the spring contact point. Due to the elastic force generated at the spring contact point at this time, the socket contact is electrically connected to the counter-connector contact.

However, in a case where insertion position is improper, such as when the counter-connector contact is inserted off the fitting plane or inserted obliquely with respect to the fitting plane, the spring contact point of the socket contact possibly shifts beyond its elastic limit so as to cause plastic deformation of a spring piece on which the spring contact point is formed, or sufficient contact pressure cannot possibly be given between the counter-connector contact and the socket contact, whereby there is a concern that reliable electrical conduction cannot be established.

Accordingly, JP 10-503319A, for example, discloses a socket contact in which a pair of beams 2 facing each other extend downward from the upper end of a box-shaped contact main body 1, a spring piece 3 extends upward from the lower end of each of the beams 2 and a spring contact point 4 is formed in the vicinity of the upper end of the spring piece 3, while the lower ends of the pair of beams 2 are respectively bent in opposite directions, and the tip ends of the bent lower ends of the beams 2 are respectively provided with displacement regulators 5, as illustrated in FIG. 11.

When the counter-connector contact is inserted into the contact main body 1 along the fitting plane C1, the counter-connector contact comes into contact with the spring contact points 4 while elastically deforming the spring pieces 3. At this time, the beams 2 also elastically shift, but as the displacement regulators 5 provided at the lower ends of the beams 2 abut an inner wall 6 of the contact main body 1, the beams 2 are prevented from further shifting.

Accordingly, even if the counter-connector contact is inserted off the fitting plane C1 or inserted obliquely with respect to the fitting plane C1, the displacement regulators 5 abut the inner wall 6 of the contact main body 1 such that the lower ends of the beams 2 are prevented from further shifting, whereby the position of the counter-connector contact is corrected.

However, since each of the spring pieces 3 extends upward from the lower end of each of the beams 2, the spring contact point 4 formed on the spring piece 3 is located in the vicinity of the upper end of the beam 2, whereas each of the displacement regulators 5 is formed at the lower end of the beam 2. In other words, because the spring contact point 4 and the displacement regulator 5 are located apart from each other in the fitting direction, the position of the counter-connector contact is corrected at the lower end of the beam 2 where the displacement regulator 5 is formed but can largely deviate from the fitting plane C1 in the vicinity of the upper end of the beam 2 where the spring contact point 4 is located.

If the position of the counter-connector contact largely deviates from the fitting plane C1 in the vicinity of the upper end of the beam 2, the contact state of the counter-connector contact with the pair of spring contact points 4 would be significantly uneven; one of the spring contact points 4 would shift so much that the corresponding spring piece 3 would easily plastically deform, and the other spring contact point 4 would be separated from the counter-connector contact and possibly result in contact failure. Hence, a problem that the reliable electrical conduction is impaired would arise.

SUMMARY OF THE INVENTION

The present invention has been made to overcome the above problem associated with the prior art and aims at providing a connector that can establish reliable electrical conduction even when a counter-connector contact is engaged as being positioned improperly.

A connector according to the present invention comprises a socket contact to be electrically connected to a counter-connector contact having a plate shape that is inserted in the socket contact along a fitting plane, wherein the socket contact includes: one or more pairs of conduction contact points that are disposed respectively on both sides of the fitting plane so as to face each other across the fitting plane in an elastically displaceable manner and that come into contact with and are electrically connected to the counter-connector contact; and one or more pairs of displacement regulator contact points that are disposed respectively on both sides of the fitting plane so as to face each other across the fitting plane and that come into contact with the counter-connector contact when the counter-connector contact shifts, thereby preventing the counter-connector contact from shifting by more than a predetermined amount, wherein the one or more pairs of conduction contact points and the one or more pairs of displacement regulator contact points are disposed side by side in a direction along the fitting plane at a substantially same depth in a fitting direction, and wherein each of the pairs of displacement regulator contact points has a gap therebetween larger than a gap between each of the pairs of conduction contact points.

DETAILED DESCRIPTION OF THE INVENTION

Figure 1A:
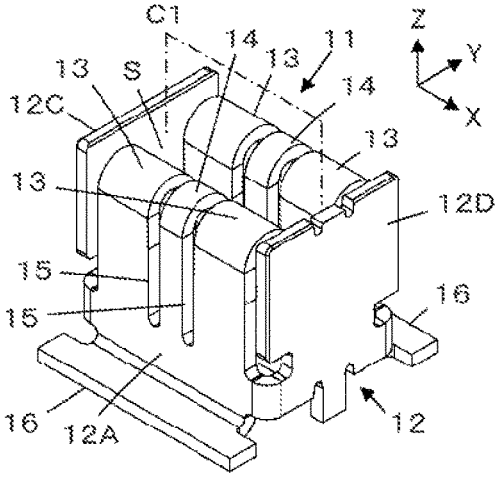
FIGS. 1A to 1D are a perspective view, a plan view, a front view, and a side view, respectively, each showing a socket contact of a connector according to Embodiment 1 of the present invention.
Figure 1B:
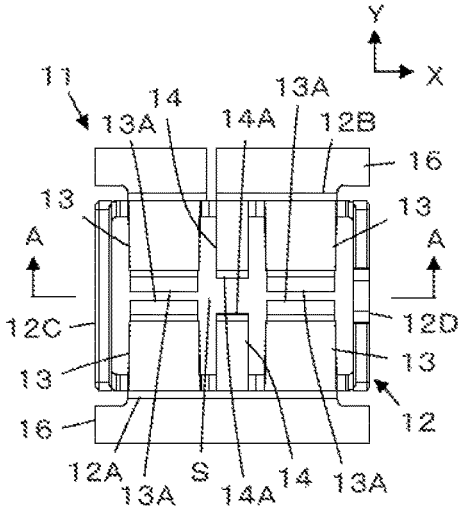
Figure 1C:
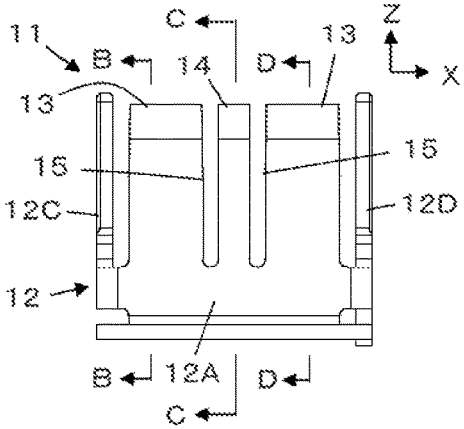
Figure 1D:
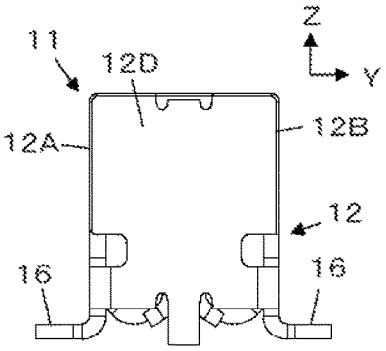

Embodiments of the present invention will be described below based on the appended drawings.

Embodiment 1

FIGS. 1A to 1D each illustrate a structure of a socket contact 11 of a connector according to Embodiment 1. The socket contact 11 is to be electrically connected to a counter-connector contact having a plate shape that is inserted along a fitting plane C1, and has a main body portion 12 made from a metal plate that is bent into a box shape. The main body portion 12 includes a front part 12A and a rear part 12B facing each other, and a pair of side surface parts 12C and 12D each joining ends of the front part 12A and ends of the rear part 12B, whereby a reception part S is formed inside the main body portion 12 to receive a counter-connector contact.

In addition, the socket contact 11 has two pairs of conduction spring pieces 13 that are respectively bent at the upper ends and on both sides of the front part 12A and of the rear part 12B of the main body portion 12 toward the inside of the reception part S and a pair of displacement regulators 14 that are respectively bent at the upper central ends of the front part 12A and of the rear part 12B toward the inside of the reception part S. That is, the front part 12A is integrally connected to one of the displacement regulators 14 and two of the conduction spring pieces 13 respectively provided on both sides of the displacement regulator 14, and, similarly, the rear part 12B is integrally connected to the other displacement regulator 14 and the other two conduction spring pieces 13 respectively provided on both sides of the displacement regulator 14.

The conduction spring pieces 13 on the front part 12A side face the conduction spring pieces 13 on the rear part 12B side inside the reception part S, and each of the conduction spring pieces 13 is provided with a conduction contact point 13A in the vicinity of its end. The conduction contact point 13A comes into contact with a counter-connector contact to establish electrical conduction.

Moreover, the displacement regulator 14 on the front part 12A side and the displacement regulator 14 on the rear part 12B side face each other inside the reception part S, and each of the displacement regulators 14 is provided with a displacement regulator contact point 14A in the vicinity of its end. The displacement regulator contact point 14A is to come into contact with a counter-connector contact to prevent the counter-connector contact from shifting by more than a predetermined amount.

In each of the front part 12A and the rear part 12B, notches 15 are provided between the displacement regulator 14 and each of the neighboring conduction spring pieces 13, thereby separating the conduction spring pieces 13 from the adjacent displacement regulator 14.

In addition, the lower ends of the front part 12A and of the rear part 12B of the main body portion 12 are connected to a pair of soldering parts 16 that are disposed on both sides of and across the fitting plane C1 and extend in the opposite directions. The soldering parts 16 are used to fix the socket contact 11 to a substrate (not shown) by means of soldering.

For the easy understanding, the direction in which the pair of side surface parts 12C and 12D of the main body portion 12 face each other is referred to as the X direction, the direction in which the front part 12A and the rear part 12B face each other is referred to as the Y direction, and the direction from the bottom toward the top of the main body portion 12 is referred to as the Y direction.

The fitting plane C1 extends along the XZ plane, and the counter-connector contact (not shown) is inserted along the fitting plane C1 in the −Z direction relatively to the socket contact 11 to be engaged.

Figure 2:
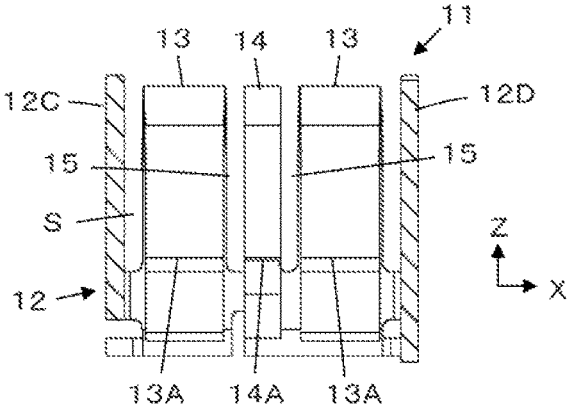
FIG. 2 is a cross-sectional view taken along line A-A of FIG. 1B.

As illustrated in FIG. 2, in the reception part S of the main body portion 12, the displacement regulator contact point 14A of each of the displacement regulators 14 and the conduction contact points 13A of the conduction spring pieces 13 disposed on both sides of the displacement regulator 14 in the X direction are disposed side by side in the X direction and at almost a same depth in the Z direction that is the direction the counter-connector contact (not shown) is engaged.

Since the displacement regulator 14 and the conduction spring pieces 13 on both sides of the displacement regulator 14 are separated by the notches 15, the respective conduction spring pieces 13 are formed to elastically deform independently from the displacement regulator 14.

Figure 3:
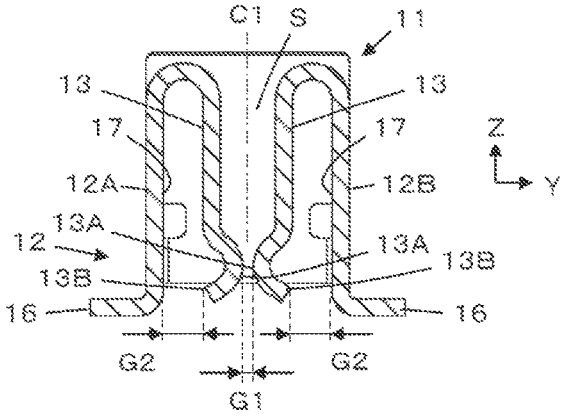
FIG. 3 is a cross-sectional view taken along line B-B of FIG. 1C.

As illustrated in FIG. 3, the conduction spring pieces 13 on the front part 12A side and the conduction spring pieces 13 on the rear part 12B side are each bent at the upper end of the main body portion 12 and extend in the −Z direction such that tip ends 13B of the conduction spring pieces 13 on either side reach the vicinity of the lower end of the main body portion 12. The conduction contact points 13A of each pair of conduction spring pieces 13 are disposed on both sides of the fitting plane C1 so as to face each other across the fitting plane C1 with a gap G1 therebetween along the Y direction. The gap G1 is set to have a value smaller than a thickness of the counter-connector contact that is not shown.

The tip ends 13B of the conduction spring pieces 13 on the front part 12A side are located farther away from the fitting plane C1 in the −Y direction than the conduction contact points 13A and face an inner wall 17 of the front part 12A with a gap G2 therefrom. Similarly, the tip ends 13B of the conduction spring pieces 13 on the rear part 12B side are located farther away from the fitting plane C1 in the +Y direction than the conduction contact points 13A and face an inner wall 17 of the rear part 12B with a gap G2 therefrom. The gap G2 is set beforehand to have a value such that even when the counter-connector contact is inserted between the respective pairs of the conduction contact points 13A, the tip ends 13B of the conduction spring pieces 13 do not come into contact with the facing inner wall 17 of the front part 12A or of the rear part 12B.

Figure 4:
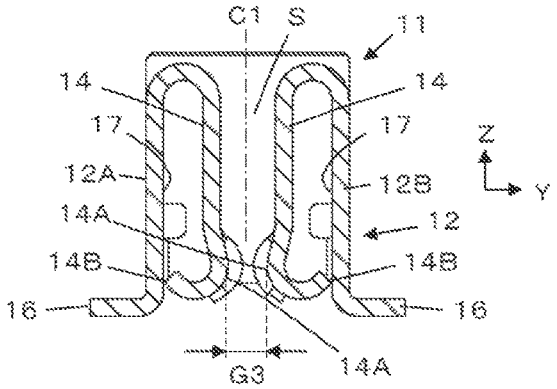
FIG. 4 is a cross-sectional view taken along line C-C of FIG. 1C.

As illustrated in FIG. 4, the displacement regulator 14 on the front part 12A side and the displacement regulator 14 on the rear part 12B side are each bent at the upper end of the main body portion 12 and extend in the −Z direction such that tip ends 14B of both the displacement regulators 14 reach the vicinity of the lower end of the main body portion 12. The displacement regulator contact points 14A of the pair of displacement regulators 14 are disposed on both sides of the fitting plane C1 so as to face each other across the fitting plane C1 with a gap G3 therebetween along the Y direction. The gap G3 is larger than the gap G1 between each pair of the conduction contact points 13A illustrated in FIG. 3 and has a value equal to or slightly larger than a thickness of the counter-connector contact.

The tip end 14B of the displacement regulator 14 on the front part 12A side is located farther away from the fitting plane C1 in the −Y direction than the displacement regulator contact point 14A and is close to the inner wall 17 of the front part 12A with a small distance therefrom. Similarly, the tip end 14B of the displacement regulator 14 on the rear part 12B side is located farther away from the fitting plane C1 in the +Y direction than the displacement regulator contact point 14A and is close to the inner wall 17 of the rear part 12B with a small distance therefrom.

With such constitution, at the time of contact with the counter-connector contact, the displacement regulator contact points 14A are pushed, and the displacement regulators 14 elastically deform, but the tip ends 14B of the displacement regulators 14 abut the facing inner walls 17 of the front part 12A and the rear part 12B after slight displacement, whereby the displacement regulators 14 are prevented from further elastically deforming.

As described above, the socket contact 1 having the main body portion 12, the two pairs of conduction spring pieces 13, the pair of displacement regulators 14 and the pair of soldering parts 16 can be produced from a metal plate, in which the notches 15 are formed to separate the conduction spring pieces 13 from the adjacent displacement regulators 14, and which is subjected to bending process.

Next, the operation of the socket contact 11 in Embodiment 1 will be described below.

Figure 5A:
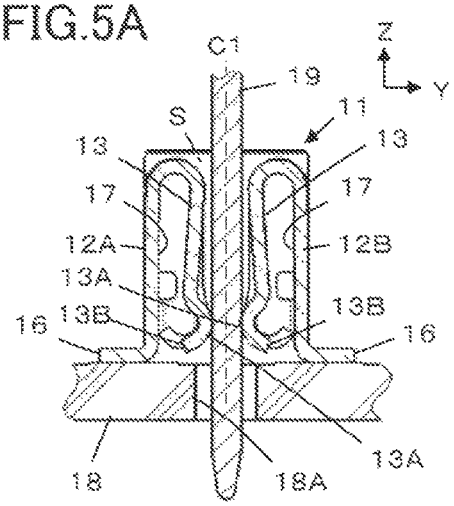
FIGS. 5A and 5B each show the socket contact in which a counter-connector contact is inserted along a fitting plane and respectively are a cross-sectional view corresponding to a cross section along line D-D of FIG. 1C and a cross-sectional view corresponding to a cross section along line C-C of FIG. 1C.

The socket contact 11 is fixed to a substrate 18 in such a manner that the pair of soldering parts 16 are soldered to fixing pads or the like of the substrate 18 as illustrated in FIG. 5A. The substrate 18 is provided with an opening 18A directly underneath the reception part S of the socket contact 11 so that the tip end of the counter-connector contact 19 is inserted into the opening 18A.

As the counter-connector contact 19 is moved relatively to the socket contact 11 along the fitting plane C1 in the −Z direction, the contact 19 enters the reception part S and subsequently advances in the −Z direction while pushing out the two pairs of conduction contact points 13A, the respective pair facing each other along the Y direction with the gap G1 therebetween, until the tip end of the contact 19 is inserted into the opening 18A of the substrate 18 and reaches a predetermined position therein, whereby engagement of the connectors is completed.

Since the predetermined gap G2 is formed between the tip end 13B of each of the conduction spring pieces 13 and the inner wall 17 of the front part 12A or of the rear part 12B as illustrated in FIG. 3, even when the counter-connector contact 19 is inserted between the respective pairs of conduction contact points 13A, the tip end 13B of either conduction spring piece 13 does not come into contact with the facing inner wall 17 of the front part 12A or of the rear part 12B.

Figure 5B:
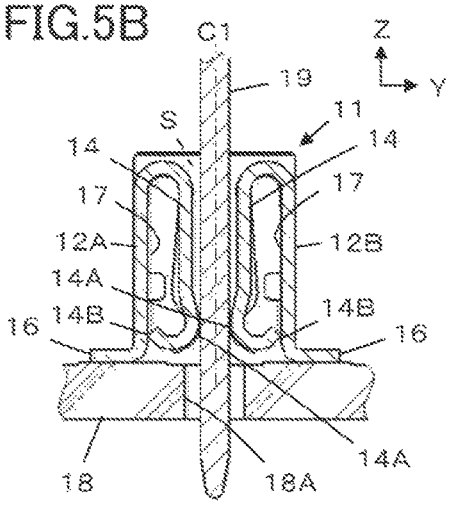

In addition, the gap G3 that is equal to or slightly larger than the thickness of the counter-connector contact 19 is formed between the displacement regulator contact points 14A that are facing each other across the fitting plane C1 as illustrated in FIG. 4. Accordingly, as illustrated in FIG. 5B, even when the counter-connector contact 19 is inserted between the displacement regulator contact points 14A that are facing each other, the displacement regulator contact points 14A do not shift as long as the contact 19 is positioned on the fitting plane C1 centrally between the facing displacement regulator contact points 14A.

Figure 6A:
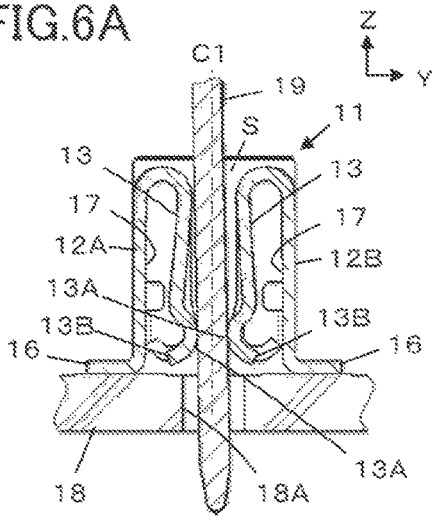
FIGS. 6A and 6B each show the socket contact in which a counter-connector contact is obliquely inserted and respectively are a cross-sectional view corresponding to a cross section along line D-D of FIG. 1C and a cross-sectional view corresponding to a cross section along line C-C of FIG. 1C.
Figure 6B:
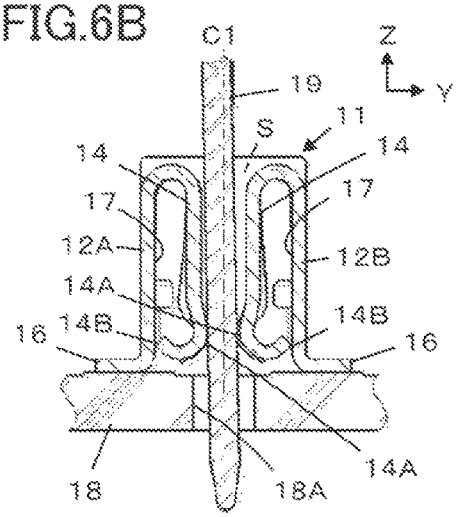

Here, a case where the counter-connector contact 19 is inserted off the fitting plane C1 toward the Y direction or where the contact 19 is inserted obliquely with respect to the fitting plane C1 is considered. Even in such case, as illustrated in FIG. 6A, the contact 19 enters the reception part S and subsequently advances in the −Z direction while pushing out the two pairs of conduction contact points 13A, the respective pair facing each other along the Y direction with the gap G1 therebetween. At this time, the contact 19 passes between the displacement regulator contact points 14A facing each other as illustrated in FIG. 6B.

As described above, the tip end 14B of each of the displacement regulators 14 is located close to the facing inner wall 17 of the front part 12A or of the rear part 12B with a small distance therefrom. Hence, at the time of contact with the counter-connector contact 19, the displacement regulator contact points 14A are pushed, and the displacement regulators 14 elastically deform, but the tip ends 14B of the displacement regulators 14 abut the facing inner walls 17 of the front part 12A and the rear part 12B after slight displacement, whereby the displacement regulators 14 are prevented from further elastically deforming. Hence, the position of the contact 19 off toward the Y direction is corrected such that the contact 19 is positioned on the fitting plane C1 between the displacement regulator contact points 14A facing each other.

As apparent from FIG. 2, the conduction contact points 13A of the conduction spring pieces 13 and the displacement regulator contact points 14A of the displacement regulators 14 are positioned at almost the same depth in the Z direction. Therefore, as illustrated in FIG. 6A, the contact 19 is positioned on the fitting plane C1 also between the respective pairs of facing conduction contact points 13A, and the contact 19 therefore is in contact evenly with the facing conduction contact points 13A, whereby any plastic deformation of the conduction spring pieces 13 due to excessive displacement of the conduction contact points 13A or contact failure due to separation of the conduction contact points 13A from the contact 19 can be prevented, and reliability of the electrical conduction can be improved.

Also, after the counter-connector contact 19 is normally inserted in the socket contact 11 along the fitting plane C1 as illustrated in FIGS. 5A and 5B and electrical conduction between the contact 19 and the two pairs of conduction contact points 13A is established, even if some stress is applied to the counter-connector contact 19 or the socket contact 11 so that the contact 19 shifts with respect to the socket contact 11, as the displacement regulator contact points 14A are pushed by the contact 19 and the displacement regulators 14 elastically deform, the tip ends 14B of the displacement regulators 14 slightly shift and abut the facing inner walls 17 of the front part 12A and of the rear part 12B, whereby the contact 19 is prevented from further shifting. Accordingly, the contact 19 can came in contact evenly with the facing conduction contact points 13A, thereby realizing reliable electrical conduction.

The tip ends 14B of the displacement regulators 14 may be in contact with the facing inner walls 17 of the front part 12A and the rear part 12B in advance, rather than being disposed near the facing inner walls 17 of the front part 12A and the rear part 12B each with a small distance from the facing inner wall 17.

Since the displacement regulator contact points 14A come into contact with the counter-connector contact 19 in this manner, the contact 19 can be positioned on the fitting plane C1 between the two respective pairs of conduction contact points 13A, and the contact 19 can be in contact evenly with the facing conduction contact points 13A, whereby reliable electrical conduction can be established.

The displacement regulators 14 do not have to have spring property, and the displacement regulator contact points 14A may be disposed fixedly in the reception part S of the main body portion 12. However, since the socket contact 11 in Embodiment 1 is produced from a metal plate, in which the notches 15 are formed to separate the conduction spring pieces 13 from the adjacent displacement regulators 14, and which is subjected to bending process, the displacement regulators 14 are also constituted as spring pieces. Therefore, the displacement regulators 14 abut the facing inner walls 17 of the front part 12A and the rear part 12B when the tip ends 14B of the displacement regulators 14 slightly shift, whereby any further elastic deformation is prevented.

Each of the displacement regulators 14 extends in the −Z direction until the tip end 14B thereof reaches the vicinity of the lower end of the main body portion 12, and the tip end 14B is located near the soldering part 16. Hence, there is a concern that, when the soldering part 16 is soldered to the substrate 18, the solder used may run to reach the tip end 14B of the displacement regulator 14. Even if the tip end 14B of the displacement regulator 14 is fixed to the facing inner wall 17 of the front part 12A or of the rear part 12B, the counter-connector contact 19 is prevented from shifting by more than a predetermined amount, and reliable electrical conduction can be realized, causing no problem.

Each of the conduction spring pieces 13 also extends in the −Z direction until the tip end 13B thereof reaches the vicinity of the lower end of the main body portion 12, but since the tip end 13B of the conduction spring piece 13 faces the inner wall 17 of the front part 12A or of the rear part 12B with a predetermined gap G2 therefrom, the tip end 13B would not be fixed to the facing inner wall 17 of the front part 12A or of the rear part 12B even if the solder used runs toward the tip end 13B.

The conduction contact points 13A and the displacement regulator contact points 14A are disposed near the lower end of the main body portion 12 and in the vicinity of the soldering parts 16 in the fitting direction, i.e., Z direction. Accordingly, a force acting on the conduction spring pieces 13 and the displacement regulators 14 generated by insertion of the counter-connector contact 19 and positional deviation of the contact 19 gives the soldering parts 16 so small a moment that the more reliable connection of the soldering parts 16 to the substrate 18 can be achieved.

Embodiment 2

In the socket contact 11 in Embodiment 1, the front part 12A and the rear part 12B of the main body portion 12 each have two conduction spring pieces 13 disposed on both sides of one displacement regulator 14. However, this is not the sole case.

Figure 7:
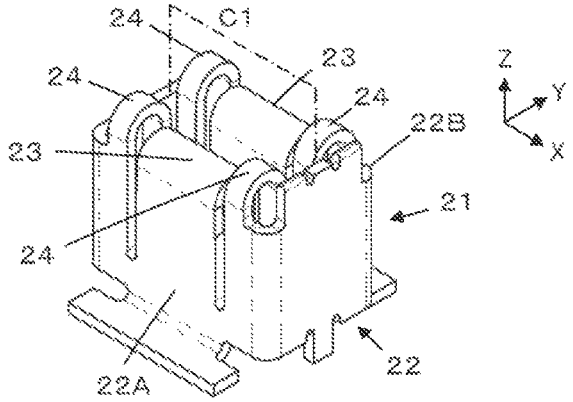
FIG. 7 is a perspective view showing a socket contact of a connector according to Embodiment 2.

In a socket contact 21 of a connector according to Embodiment 2 as illustrated in FIG. 7, a front part 22A and a rear part 22B of a main body portion 22 each have two displacement regulators 24 disposed on both sides of a conduction spring piece 23. That is, the socket contact 21 has a pair of conduction spring pieces 23 and two pairs of displacement regulators 24. Each of the conduction spring pieces 23 and each of the displacement regulators 24 are constituted as identical to the conduction spring piece 13 and the displacement regulator 14 used in Embodiment 1, respectively.

Having such constitution, the socket contact 21 can realize reliable electrical conduction similarly to the socket contact 11 in Embodiment 1, even if the counter-connector contact 19 is inserted off the fitting plane C1 toward the Y direction or inserted obliquely with respect to the fitting plane C1.

In addition, the socket contact 21 can be structured such that a plurality of conduction spring pieces 23 and a plurality of displacement regulators 24 are arrayed in each of the front part 22A and the rear part 22B of the main body portion 22.

Embodiment 3

Figure 8A:
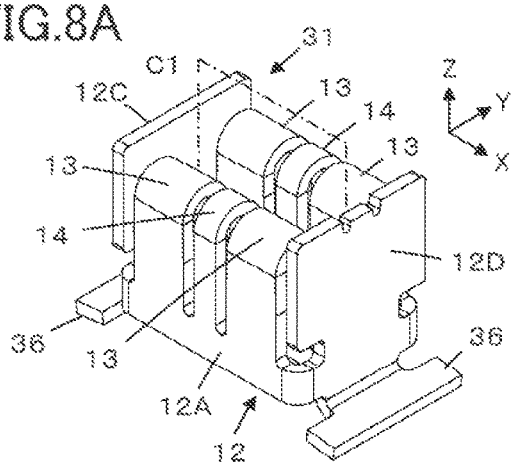
FIGS. 8A and 8B are a perspective view and a front view, respectively, each showing a socket contact of a connector according to Embodiment 3.
Figure 8B:
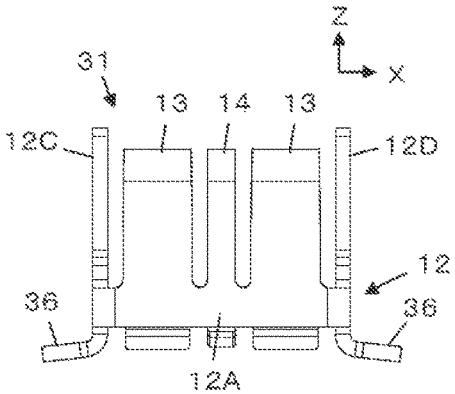
Figure 9A:
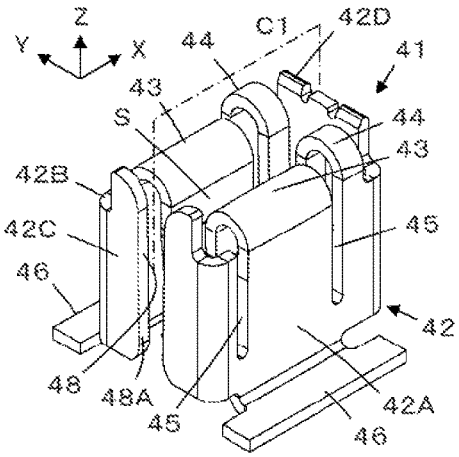
FIGS. 9A to 9F are a perspective view viewed from a left front side, a perspective view viewed from a right front side, a plan view, a front view, a left side view, and a right side view, respectively, each showing a socket contact of a connector according to Embodiment 4.
Figure 9B:
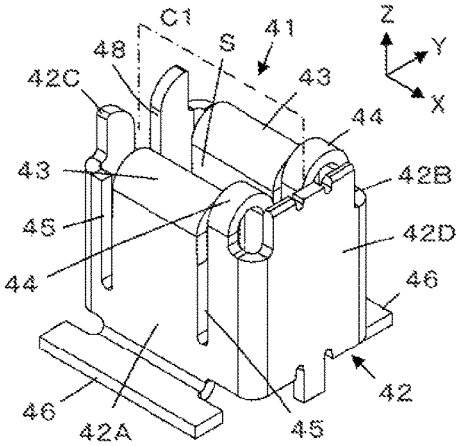
Figure 9C:
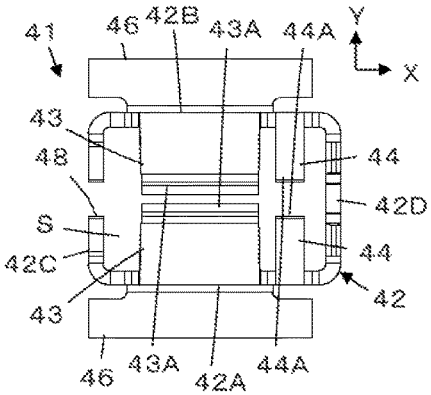
Figure 9D:
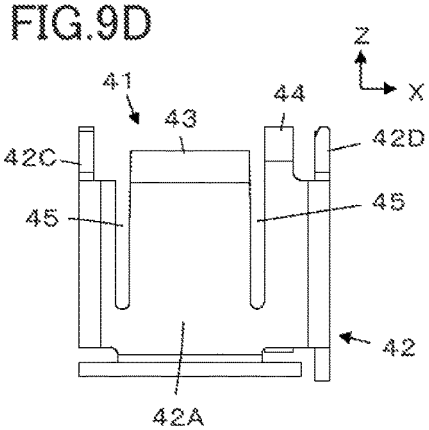
Figure 9E:
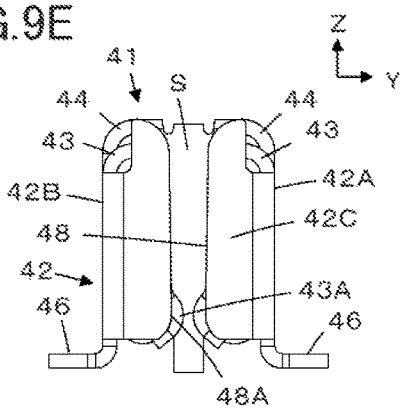
Figure 9F:
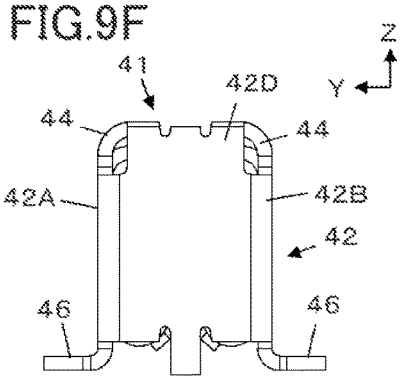

In the socket contact 11 in Embodiment 1, the soldering parts 16 are joined to the lower ends of the front part 12A and the rear part 12B of the main body portion 12 respectively so as to face each other across the fitting plane C1. However, as in a socket contact 31 of a connector according to Embodiment 3 illustrated in FIGS. 8A and 8B, soldering parts 36 can be joined to the lower ends of a pair of side surface parts 12C and 12D of the main body portion 12 respectively such that a pair of the soldering parts 36 are disposed to face each other in the direction along the fitting plane C1.

In the socket contact having such constitution, the soldering parts 36 extending in the Y direction along the side surface parts 12C and 12D are formed. Therefore, a force acting on the conduction spring pieces 13 and the displacement regulators 14 generated by insertion of the counter-connector contact 19 and positional deviation of the contact 19 is received by the soldering parts 16 extending in the Y direction, whereby the connection reliability of the soldering parts 36 to the substrate 18 can be improved.

Embodiment 4

FIGS. 9A to 9F each illustrate a structure of a socket contact 41 of a connector according to Embodiment 4. Similarly to the socket contact 11 in Embodiment 1, the socket contact 41 comprises a front part 42A and a rear part 42B that face each other, and a pair of side surface parts 42C and 42D, together forming a main body portion 42 inside of which a reception part S is formed.

In each of the front part 42A and the rear part 42B of the main body portion 42, a conduction spring piece 43 and a displacement regulator 44 are disposed side by side. Inside the reception part S, a conduction contact point 43A is formed near the tip end of the conduction spring piece 43, while a displacement regulator contact point 44A is formed near the tip end of the displacement regulator 44.

The conduction spring piece 43 and the displacement regulator 44 are respectively constituted as identical to the conduction spring piece 13 and the displacement regulator 14 used in Embodiment 1, and the conduction contact point 43A and the displacement regulator contact point 44A are disposed side by side in the X direction at the substantially same depth in the Z direction.

In each of the front part 42A and the rear part 42B, a notch 45 extending in the Z direction is provided between the conduction spring piece 43 and the displacement regulator 44 and thus separates the conduction spring piece 43 from the adjacent displacement regulator 44. In addition, another notch 45 extending in the Z direction is also provided between the conduction spring piece 43 and the side surface part 42C and thus separates the conduction spring piece 43 from the side surface part 42C. Having these notches 45, the socket contact 41 is constituted such that the conduction spring pieces 43 elastically deform independently from the displacement regulators 44.

The side surface part 42D of the pair of side surface parts 42C and 42D joins the front part 42A and the rear part 42B so as to close the end of the reception part S on the +X direction side, whereas the other side surface part 42C is provided with a slit 48 extending from its end on the +Z direction side to the other end on the −Z direction side along the fitting plane C1, and the side surface part 42C is separated by the slit 48 into a part on the front part 42A side and the other part on the rear part 42B side. The reception part S is open at its end on the −X direction side through the slit 48.

The split parts of the side surface part 42C on the front part 42A side and on the rear part 42B side are respectively provided with displacement regulator contact points 48A facing each other across the slit 48 and disposed at the same depth in the Z direction as the conduction contact points 43A and the displacement regulator contact points 44A. These displacement regulator contact points 48A are apart from each other by a gap substantially same as the gap between the displacement regulator contact points 44A, and the gap has a value identical to or slightly larger than that of the thickness of the contact 19. An opening width of the slit 48 is smallest at the displacement regulator contact points 48A and is larger than the gap between the displacement regulator contact points 48A at the other portions.

Soldering parts 46 are respectively joined to the lower ends of the front part 42A and of the rear part 42B of the main body portion 42.

Figure 10A:
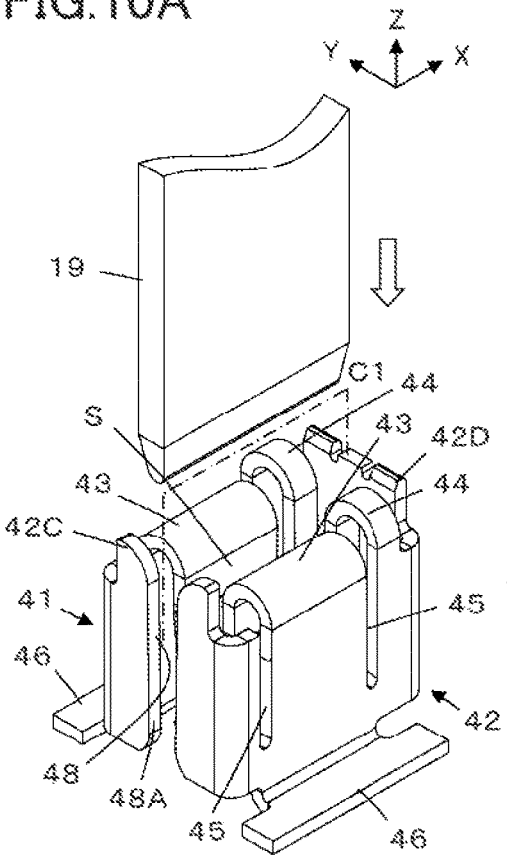
FIGS. 10A and 10B are a perspective view and a front view, respectively, each showing how a counter-connector contact is inserted into the socket contact of the connector according to Embodiment 4.
Figure 10B:
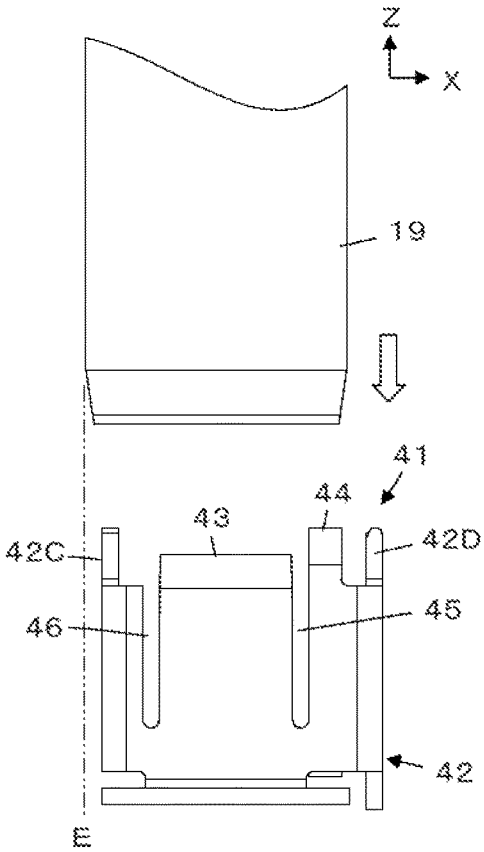
Figure 11:
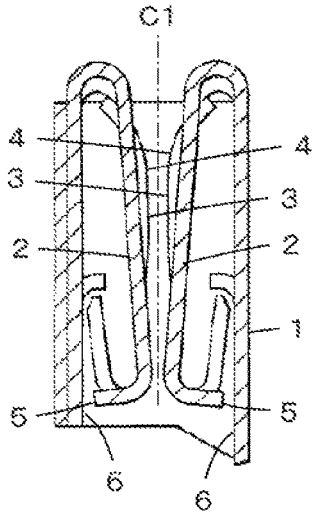
FIG.11 PRIOR ART
FIG. 11 is a cross-sectional view showing a socket contact of a conventional connector.

At the time of engagement of the connectors, as illustrated in FIG. 10A, the counter-connector contact 19 moves along the fitting plane C1 in the −Z direction relatively to the socket contact 41. Having its end E in the −X direction located outside the side surface part 42C of the socket contact 41 as illustrated in FIG. 10B, the contact 19 is inserted into the reception part S and, at the same time, into the slit 48 of the side surface part 42C.

The contact 19 then advances in the −Z direction as pushing out the pair of conduction contact points 43A inside the reception part S, whereby the engagement of the connectors is completed.

If the counter-connector contact 19 is inserted off the fitting plane C1 toward the Y direction or inserted obliquely with respect to the fitting plane C1, similarly to the socket contact 11 in Embodiment 1, the displacement regulator contact points 44A of the displacement regulators 44 and the displacement regulator contact points 48A in the slit 48 correct the position of the contact 19 in the Y direction. Accordingly, the contact 19 comes into contact evenly with the pair of conduction contact points 43A, avoiding plastic deformation of the conduction spring pieces 43 due to an excessive displacement of the conduction contact points 43A and contact failure due to separation of the conduction contact points 43A from the contact 19, thereby improving the reliability of the electrical conduction.

In the socket contact 41 in Embodiment 4, since the counter-connector contact 19 is fitted as having its end E in the −X direction sticking out the side surface part 42C, the length of the socket contact 41 in the X direction, i.e., the length of the contact 19 in the width direction, can be smaller than that of the socket contact 11 in Embodiment 1, whereby the socket contact 41 can be reduced in size.

Each of the connectors according to Embodiments 1 to 4 can be constituted either as a single-contact structure having one socket contact 11, 21, 31 or 41 or as a multiple-contact connector having a plurality of socket contacts 11, 21, 31 or 41 arrayed to be respectively electrically connected to a plurality of counter-connector contacts 19.

What is claimed is:

1. A connector comprising a socket contact to be electrically connected to a counter-connector contact having a plate shape that is inserted in the socket contact along a fitting plane, wherein the socket contact includes:

a main body portion that forms a reception part to accommodate the counter-connector contact and has inner walls;

a plurality of conduction spring pieces which are connected to the main body portion and tip ends of which are disposed inside the reception part, a plurality of displacement regulators which are connected to the main body portion, tip ends of which being disposed inside the reception part, one or more pairs of conduction contact points that are provided at the tip ends of the conduction spring pieces and that are disposed respectively on both sides of the fitting plane so as to face each other across the fitting plane in an elastically displaceable manner and that come into contact with and are electrically connected to the counter-connector contact; and one or more pairs of displacement regulator contact points that are respectively provided near the tip ends of the plurality of displacement regulators and that are disposed respectively on both sides of the fitting plane so as to face each other across the fitting plane, wherein the one or more pairs of conduction contact points and the one or more pairs of displacement regulator contact points are disposed side by side in a direction along the fitting plane at a substantially same depth in a fitting direction, wherein each of the pairs of displacement regulator contact points has a gap therebetween larger than a gap between each of the pairs of conduction contact points, and wherein the tip ends of the displacement regulator each are located farther away from the fitting plane than the displacement regulator contact points and are in contact with the inner wall or are close to the inner wall with a small distance therebetween, such that, when the counter-connector contact shifts, the counter-connector contact comes into contact with the displacement regulator contact points and upon the displacement regulators being elastically deformed the tip ends of the displacement regulators abut the facing inner walls so as to prevent the counter-connector contact from further shifting.

2. The connector according to claim 1, wherein the main body portion, the plurality of conduction spring pieces and the plurality of displacement regulators are made from a single metal plate, and a notch is provided and separates between a conduction spring piece and a displacement regulator neighboring each other.

3. The connector according to claim 2, wherein the socket contact includes:

a pair of the displacement regulators; and two pairs of the conduction spring pieces, the two pairs being respectively disposed on both sides of the pair of the displacement regulators side by side along the fitting plane.

4. The connector according to claim 2, wherein the socket contact includes:

a pair of the conduction spring pieces; and two pairs of the displacement regulators, the two pairs being respectively disposed on both sides of the pair of the conduction spring pieces side by side along the fitting plane.

5. The connector according to claim 2, wherein each of the plurality of displacement regulators is separated from a neighboring conduction spring piece of the plurality of conduction spring pieces by the notch and has a spring piece shape as the plurality of displacement regulators are made together with the plurality of the conduction spring pieces from the metal plate that is subjected to bending process.

6. The connector according to claim 1, wherein the socket contact includes a pair of soldering parts connected to the main body portion and extending respectively in opposite directions for fixing the socket contact to a substrate by means of soldering.

7. The connector according to claim 6, wherein the pair of soldering parts are disposed respectively on both sides of and across the fitting plane.

8. The connector according to claim 7, wherein the main body portion includes a pair of side surface parts disposed in a direction along the fitting plane to face each other, and wherein one of the pair of side surface parts has a slit that extends from an end to another end thereof along the fitting plane and allows the counter-connector contact to be inserted therethrough.

9. The connector according to claim 6, wherein the pair of soldering parts are disposed so as to face each other in a direction along the fitting plane.

* * * * *